US008138918B2

(12) United States Patent
Habib et al.

(10) Patent No.: US 8,138,918 B2
(45) Date of Patent: Mar. 20, 2012

(54) INTRUSION DETECTION AND TRACKING SYSTEM

(75) Inventors: Toni S. Habib, Marlborough, MA (US); Wassim S. Habib, Dover, MA (US)

(73) Assignee: Raytheon Company, Waltham, MA (US)

( * ) Notice: Subject to any disclaimer, the term of this patent is extended or adjusted under 35 U.S.C. 154(b) by 321 days.

(21) Appl. No.: 12/562,036

(22) Filed: Sep. 17, 2009

(65) Prior Publication Data

US 2011/0063110 A1 Mar. 17, 2011

(51) Int. Cl.
*G08B 13/18* (2006.01)

(52) U.S. Cl. ..... 340/552; 340/553; 340/539.22; 340/286.02; 340/551; 340/539.26; 342/126; 342/146

(58) Field of Classification Search ..... 340/552, 340/553, 539.22, 539.26, 286.02; 342/126, 342/146

See application file for complete search history.

(56) References Cited

U.S. PATENT DOCUMENTS

| | | | | |
|---|---|---|---|---|
| 6,710,736 | B2 * | 3/2004 | Fullerton et al. | 342/28 |
| 6,832,251 | B1 * | 12/2004 | Gelvin et al. | 709/224 |
| 7,088,236 | B2 | 8/2006 | Sørensen | |
| 7,126,951 | B2 | 10/2006 | Belcea et al. | |
| 7,129,886 | B2 | 10/2006 | Hall et al. | |
| 7,154,392 | B2 * | 12/2006 | Rastegar et al. | 340/552 |
| 7,295,109 | B2 | 11/2007 | Kobayashi | |
| 7,409,716 | B2 | 8/2008 | Barnett et al. | |
| 7,733,220 | B2 | 6/2010 | Libby | |
| 2002/0094780 | A1 | 7/2002 | Payton et al. | |
| 2003/0043073 | A1 | 3/2003 | Gray et al. | |
| 2003/0228035 | A1 | 12/2003 | Parunak et al. | |
| 2004/0021599 | A1 | 2/2004 | Hall et al. | |
| 2005/0055568 | A1 | 3/2005 | Agrawala et al. | |
| 2006/0007001 | A1 | 1/2006 | Rastegar et al. | |
| 2007/0184852 | A1 | 8/2007 | Johnson et al. | |
| 2008/0018464 | A1 | 1/2008 | van Doorn et al. | |
| 2008/0143529 | A1 | 6/2008 | Gauvreau | |
| 2009/0315699 | A1 | 12/2009 | Satish et al. | |

FOREIGN PATENT DOCUMENTS

JP 2006172072 A 6/2006

OTHER PUBLICATIONS

Federal Laboratory Consortium for Technology Transfer, NewsLink Magazine, Sep. 2010; (http://www.federallabs.org/news/classifieds/).

Arora, et al.; "A line in the sand: a wireless sensor network for target detection, classification, and tracking;" Elsevier, Computer Networks; vol. 46; Jul. 2004; pp. 605-634.

(Continued)

*Primary Examiner* — Tai T Nguyen

(74) *Attorney, Agent, or Firm* — Daly, Crowley, Mofford & Durkee, LLP

(57) ABSTRACT

An intrusion detection and tracking system includes a plurality of nodes, a DP and a gateway. The nodes are disposed about an area and form a wireless network to be monitored, the nodes are configured to receive data and transmit data frames with a signal strength indicator and/or a link quality indicator in the frames. The DP is communicatively connected to the network and configured to analyze variations in the signal strength indicator and/or link quality indicator to detect and track disturbances to an electromagnetic field in the area. The gateway is configured to form a data link between the network and the DP.

28 Claims, 7 Drawing Sheets

OTHER PUBLICATIONS

Becker, et al.; Experimental Study: Link Quality and Deployment Issues in Wireless Sensor Networks; Networking 2009; LNCS 5550, pp. 14-25.
Dai, et al.; Light-Weight Target Tracking in Dense Wireless Sensor Networks; Fifth International Conference on Mobile Ad-hoc and Sensor Networks; Dec. 2009 (Abstract Only).
Gungor, et al; Resource-Aware and Link Quality Based Routing Metric for Wireless Sensor and Actor Networks; IEEE Xplore Digital Library; Jun. 2007 (Abstract Only).
Hussain, et al.; Using Received Signal Strength Variation for Surveillance in Residential Areas; http://www.xbow.com; Mar. 2008, 6 pages.
Kang, et al.; "Power-Aware Markov Chain Based Tracking Approach for Wireless Sensor Networks;" Wireless Communications and Networking Conference, IEEE; Mar. 2007.
Kaltiokallio, et al.; "Distributed RSSI processing for intrusion detection in indoor environments;" The ACM Portal; Apr. 2010 (Abstract Only).
Kurschi, et al.; "A Two-Layered Deployment Scheme for Wireless Sensor Network based Location Tracking;" Fifth International Conference on Information Technology: New Generation (itng 2008); Apr. 2008 (Abstract Only).
Ouyang, et al.; "A Comprehensive Real-Time High-Performance Object-Tracking Approach for Wireless Sensor Networks;" Fifth International Conference on Mobile Ad-hoc and Sensor Networks; Dec. 2009 (Abstract Only).
Xu, et al.; "A Novel Localization Algorithm Based on Received Signal Strength Indicator for Wireless Sensor Networks;" International Conference on Computer Science and Information Technology; Aug.-Sep. 2008 (Abstract Only).
Yan, et al., "RPLRE: A Routing Protocol Based on LQI and Residual Energy for Wireless Sensor Networks;" First International Conference on Information Science and Engineering; Dec. 2009 (Abstract Only).
PCT Search Report of the ISA for PCT/US2010/047253 dated Aug. 31, 2010.
Written Opinion of the ISA for PCT/US2010/047253 dated Aug. 31, 2010.
Kim Zetter, "Wireless Network Signals Produce See-Through Walls", Oct. 2, 2009, http://www.wired.com/threatlevel/2009/10/see-through-walls.
"Wireless Network Modded to See Through Walls", MIT Technology Review, the physics arXiv blog, Oct. 1, 2009, http://www.technologyreview.com/blog/arxiv/24193/.
Joey Wilson and Neal Patwari, "Through-Wall Tracking Using Variance-Based Radio Tomography Networks", http://arxiv.org/abs/0909.5417, submitted on Sep. 29, 2009 (v1), last revised Oct. 1, 2009 (this version, v2).
Invitation to Pay Additional Fees with Partial International Search Report, date of mailing Dec. 6, 2011, PCT/US2011/044972, 9 pages.
Youssef, et al.; "Challenges: Device-free Passive Localization for Wireless Environments," Sep. 9, 2007, XP007919817, Proceedings of the 13$^{th}$ Annual ACM International Conference on Mobile Computing and Networking, Montreal Quebec, Canada, 8 pages.

* cited by examiner

INTRUSION DETECTION AND TRACKING SYSTEM

BACKGROUND OF THE INVENTION

1. Field of the Invention

The present invention relates to an intrusion detection and tracking system. Specifically, the present invention is for an intrusion detection and tracking system for an area or perimeter having an ad-hoc wireless network.

2. Background Information

Area intrusion detection based on ad-hoc wireless sensor networks requires the use of energy demanding and relatively costly sensors for their operation. Reliable accurate sensors with low sensitivity to environmental changes are both costly and power demanding. These limitations render such networks unsuitable for use in area (perimeter or border) intrusion detection applications where low cost, extended sensing range and power autonomy are three of the most important requirements driving the design of the system. Such conflicting performance and cost requirements frequently lead to compromises in the design of wireless sensor networks.

New designs for lower cost sensors appear continuously in the market. However, in an attempt to reduce production cost, greater demand is being imposed on the processing unit of the wireless nodes of the network. This increased demand increases energy consumption by the nodes which, in turn, negatively impacts energy autonomy of the system. Attempts have been made to increase the range of the sensors from a few feet to ten feet or greater. However, the increased cost and complexity of the enhanced sensors rendered them unsuitable for wireless network area intrusion detection application. More complex software algorithms were developed to produce energy efficient wireless networks for the purpose of maximizing the autonomy of wireless network intrusion detection systems. The majority of these attempts focused on producing efficient routing algorithms for the purpose of minimizing the average transmission time of the wireless nodes of the sensor networks, thus reducing their energy consumption. However, this required the use of an increased number of higher power processing units.

In view of the above, it will be apparent to those skilled in the art that a need exists for an improved intrusion detection system. This invention addresses this need as well as other needs, which will become apparent to those skilled in the art from this disclosure.

SUMMARY OF THE INVENTION

It is an object of the present invention to provide an area intrusion detection and tracking system that is energy efficient and uses an ad-hoc wireless network.

In order to achieve the above-mentioned object and other objects of the present invention, an intrusion detection and tracking system is provided that comprises a plurality of nodes, a data processor (DP) and a gateway. The nodes are disposed about an area and form a wireless network to be monitored, the nodes being configured to receive data and transmit data frames with a signal strength indicator and/or a link quality indicator in the frames. The DP is communicatively connected to the network and configured to analyze variations in the signal strength indicator and/or link quality indicator to detect and track disturbances to an electromagnetic field in the area. The gateway is configured to form a data link between the network and the DP.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings, which form a part of this original disclosure.

DETAILED DESCRIPTION OF THE PREFERRED EMBODIMENTS

A preferred embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

Figure 1:
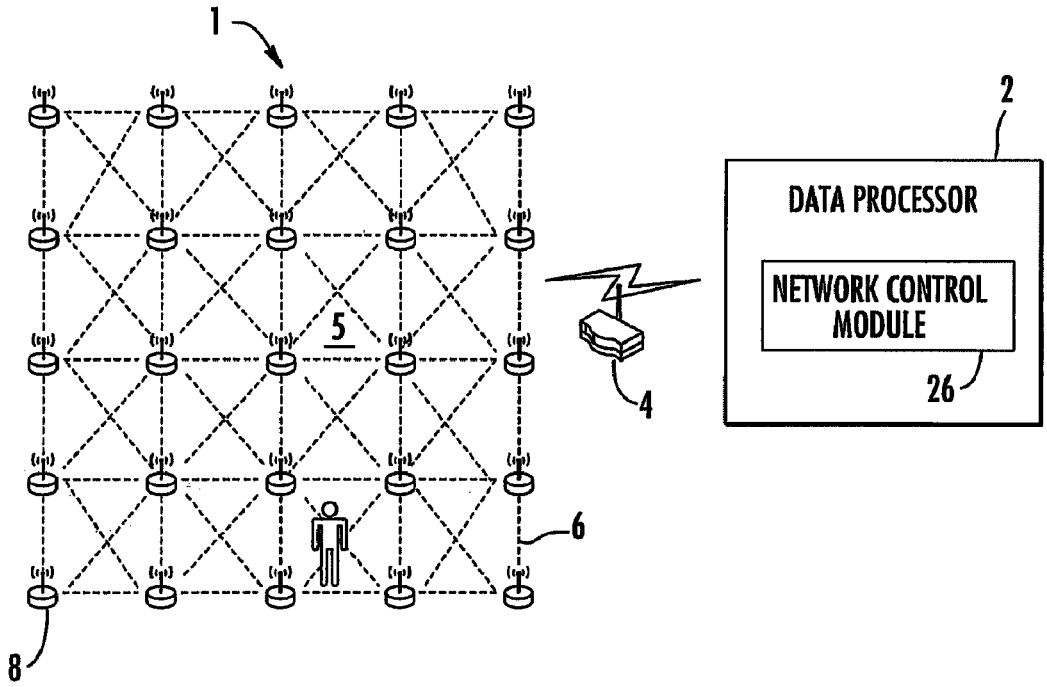
FIG. 1 is a view of an intrusion detection and tracking system according to an embodiment of the present invention.
Figure 2:
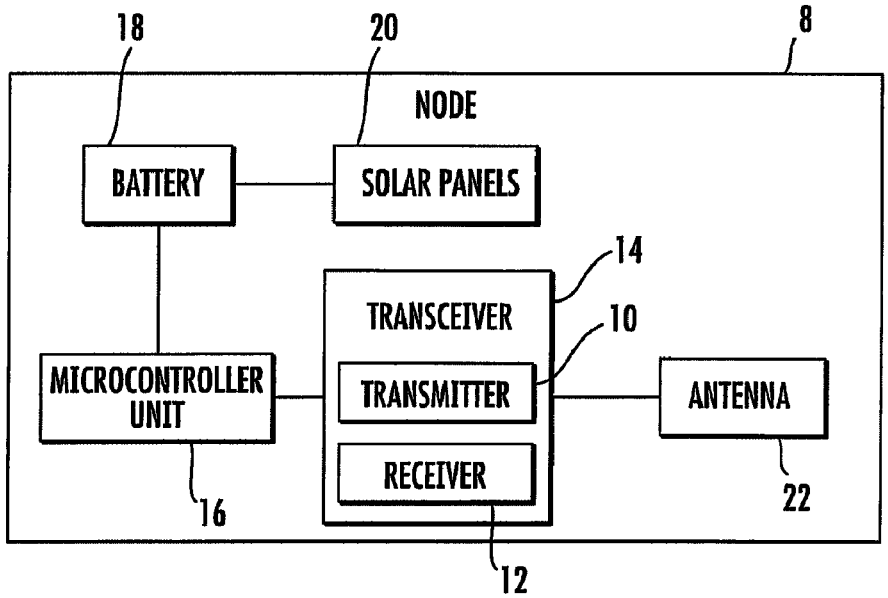
FIG. 2 is a schematic view of a node used in the intrusion detection and tracking system.

Referring initially to FIG. 1, an intrusion detection and tracking system for an area 5 or perimeter is shown generally at 1. The system 1 includes a DP 2, a gateway 4 and a wireless network 6, which includes a plurality of wireless transceiver nodes 8. As shown in FIG. 2, each node 8 includes a transmitter 10 and a receiver 12, which together form a transceiver 14.

Eliminating the need for external sensors to detect intrusion in the vicinity of the individual nodes of wireless sensor networks significantly lessens both the cost and the energy requirement of the system. Energy savings are achieved by completely eliminating the need for power to drive the sensors and by considerably decreasing processing requirement needed to sample a signal. Substitutional functionality of the eliminated sensors is achieved by using the communication protocol of the nodes 8 of the wireless network 6, which provides ready availability of intrusion sensing information without the need for extra processing power. Hence, the intrusion sensing range of each of the nodes 8 in the wireless network 6 is increased to the full transmission range of each node transmitter 10. Moreover, lower overall system energy requirements allow the use of small solar panels 20 to recharge small onboard rechargeable battery cells 18, thus increasing autonomy of the system 1.

The present invention is a novel and cost effective approach to intrusion detection and tracking using the disturbance of the electromagnetic field of low-cost COTS transceivers in nodes 8 to detect and track targets of interest. The present invention eliminates the need of very costly power and communication infrastructures associated with current technologies. Unburdened by such infrastructure requirements, the present invention can dramatically change how and where perimeter and area (or border/perimeter) detection will be performed to better protect critical facilities and the like.

The wireless network 6 sets up an electromagnetic field over an area 5, using nodes 8 having low power miniature commercial off the shelf (COTS) System on a Chip (SoC) transceiver devices deployed in a wireless network configuration. The system 1 analyzes disturbances to the produced electromagnetic field by monitoring a signal strength indicator, e.g. the Received Signal Indicator (RSSI), and a link quality indicator, e.g. the Link Quality Index (LQI), at the receivers 12 to detect and track intrusions in the area 5 or perimeter. This produces an easily deployed, persistent, and very cost effective/energy efficient intrusion detection and tracking system 1 to protect, for example, critical facilities, military bases or borders.

One of the biggest issues to intrusion detection systems is high cost (sensor, infrastructure, deployment). This cost is usually a result of either the sensor cost and/or the power and communication infrastructure cost required to use the sensors. Since cost is a major driving factor in procurement of security systems, whether for perimeter security or for area security like border protection, many design compromises are made at the security system level, resulting in degraded overall system performance. The present invention uses low cost transceivers that utilize a communication protocol, such as but not limited to the IEEE 802.15.4 communication protocol, to form the wireless network 6 which not only lowers costs, but also reduces the need for power and communication infrastructure, thereby allowing the system 1 of the present invention to be installed virtually anywhere that detection and tracking is required.

The wireless transceiver nodes 8 in the network 6 use a communication protocol, that includes values for a signal strength indicator and a link quality indicator in any transmitted frame. In one embodiment, the communication protocol is the IEEE 802.15.4 communication protocol, which is intended for industrial and medical applications. The IEEE 802.15.4 communication protocol includes RSSI and LQI values in any transmitted frame. In this embodiment, the system 1 uses electronic transmissions made in compliance with this protocol in a new way: to detect and track intrusions.

As the transceivers 14 radiate outward from the transmitting nodes' 8 antennae 22, electromagnetic waves are reflected by the obstacles they strike and have their directions of travel altered. A fraction of their energy is also absorbed by the struck obstacle causing attenuated waves that proceed in the original direction of travel. As a result, different out-of-phase direct, reflected, and absorbed waves are received by the nodes' 8 antennae 22, and their instantaneous vector sum determines the received signal energy.

Figure 3A:
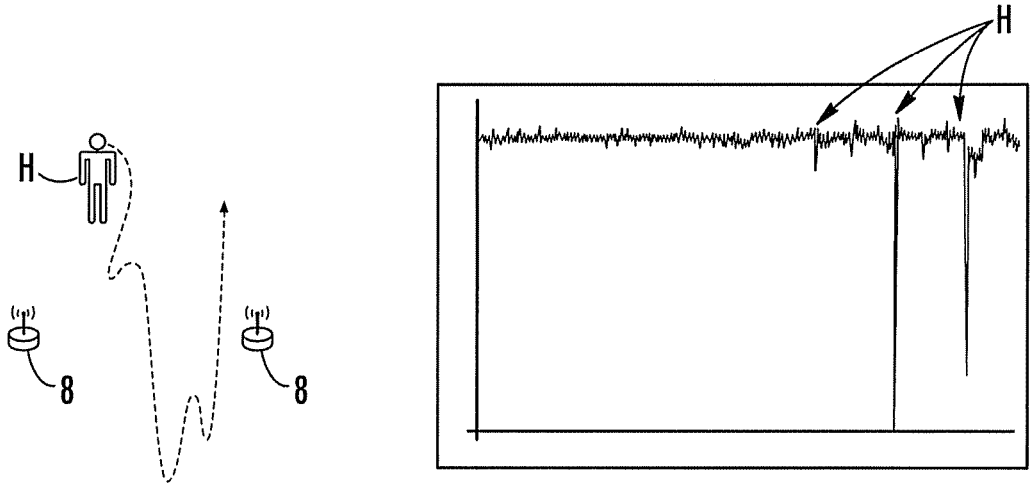
FIG. 3A is a perspective view of a human target travelling between two nodes and a graph of variations caused by the human target.
Figure 3B:
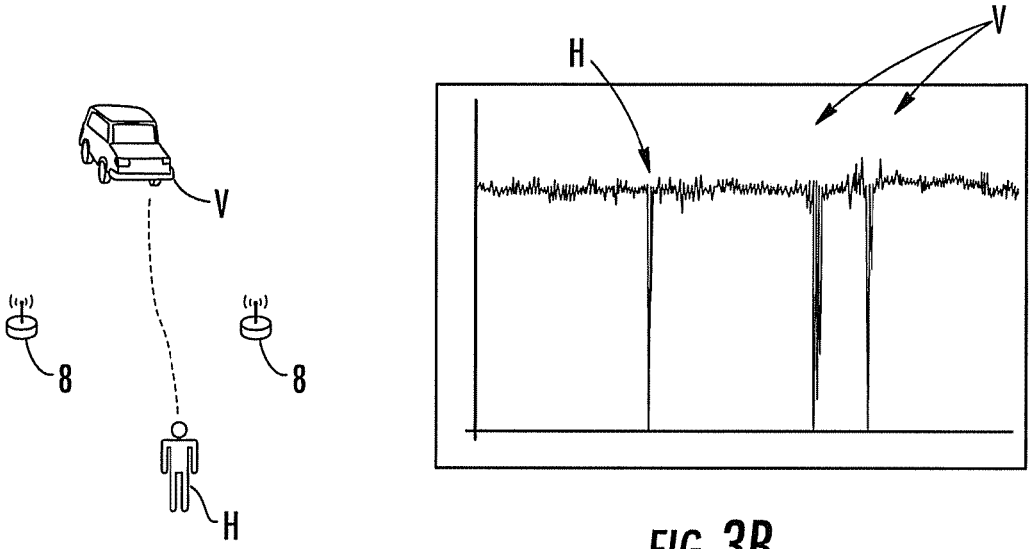
FIG. 3B is a perspective view of a human target or a vehicle travelling between two nodes and a graph of variations caused by the human target and vehicle.
Figure 4:
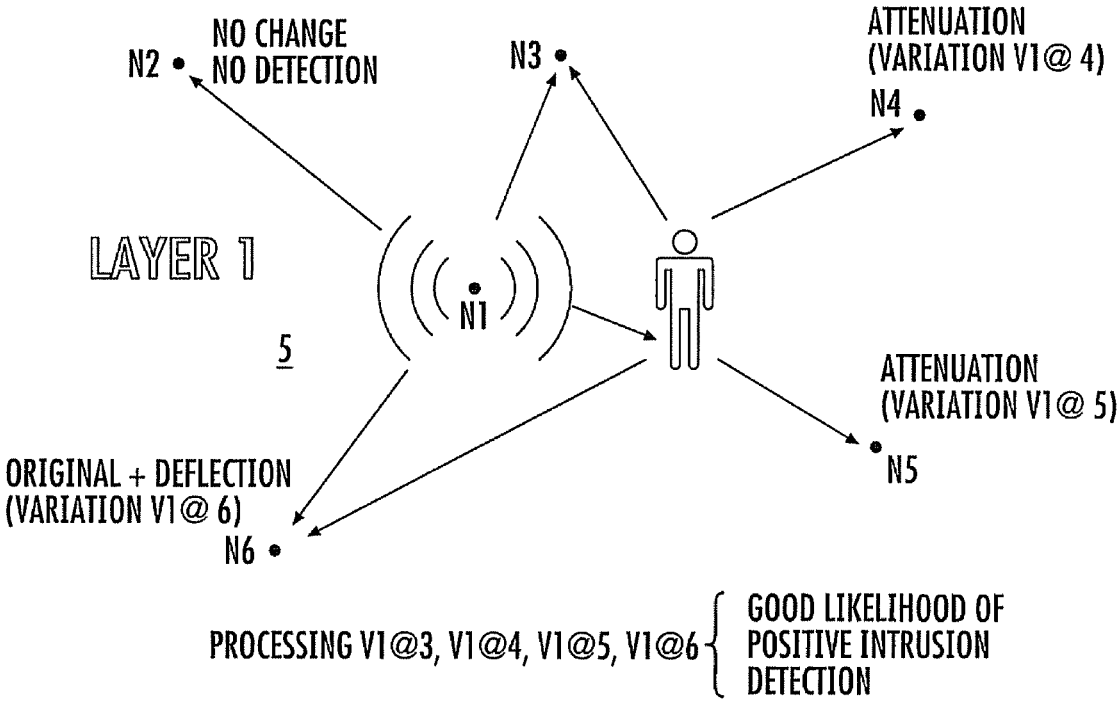
FIG. 4 is a schematic view of a Layer 1 intrusion confirmation of the intrusion detection and tracking system.
Figure 5:
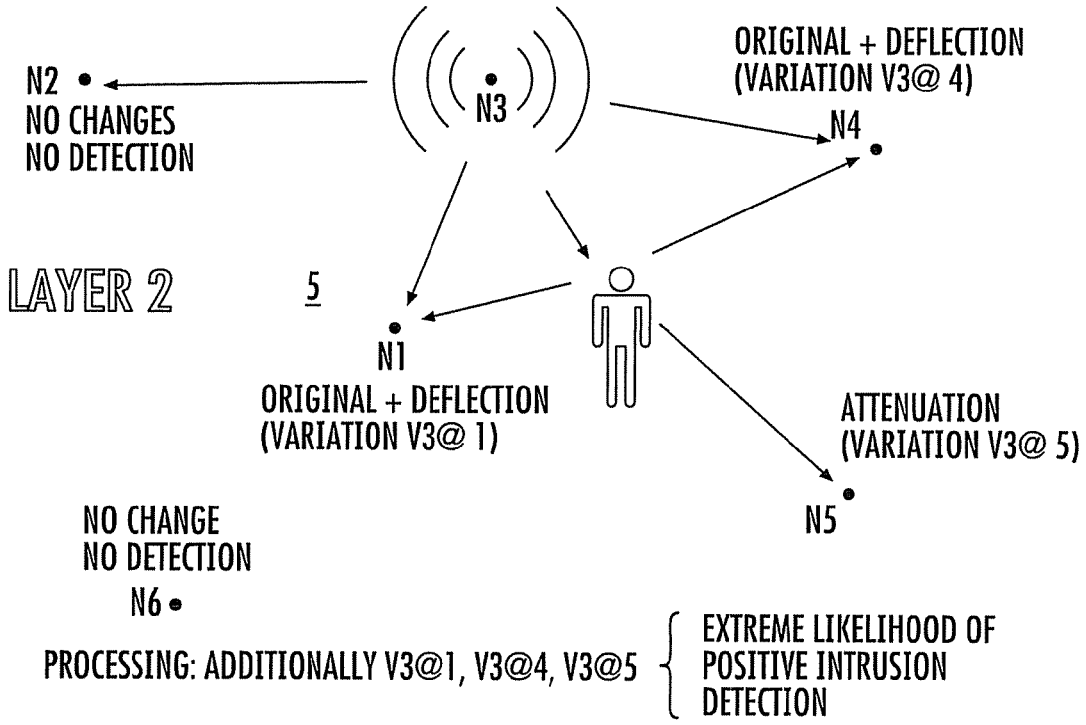
FIG. 5 is a schematic view of a Layer 2 intrusion confirmation of the intrusion detection and tracking system.
Figure 6:
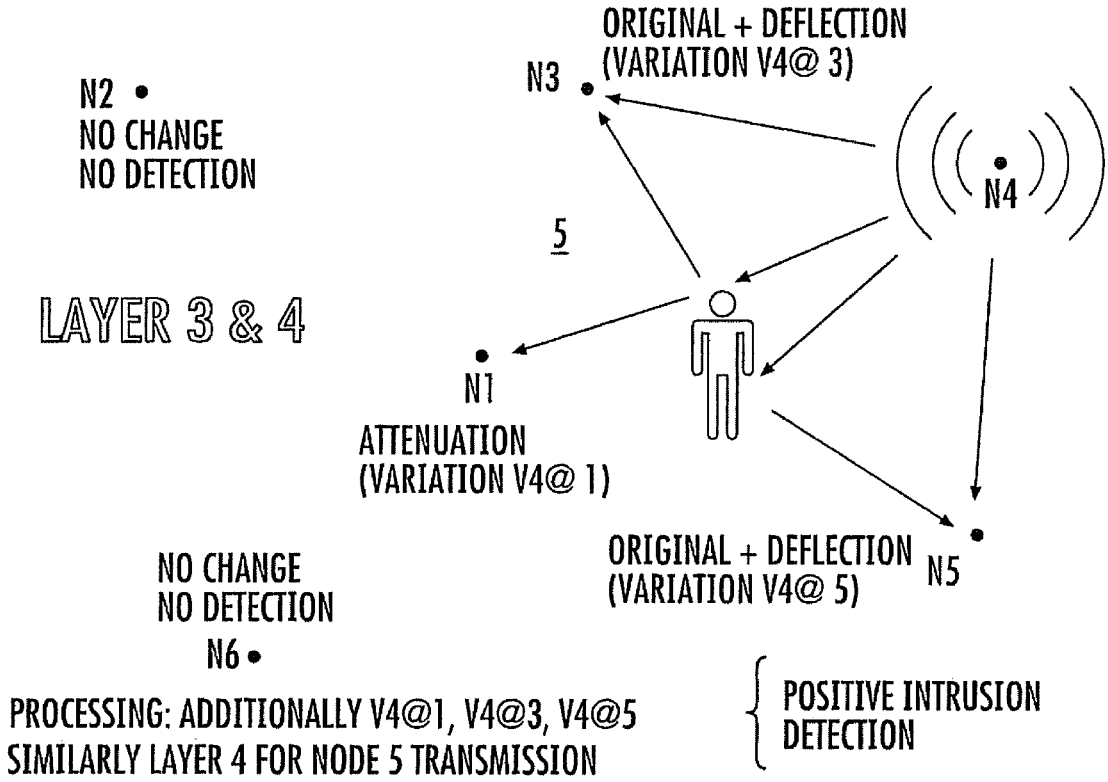
FIG. 6 is a schematic view of a Layers 3 and 4 intrusion confirmations of the intrusion detection and tracking system.
Figure 7:
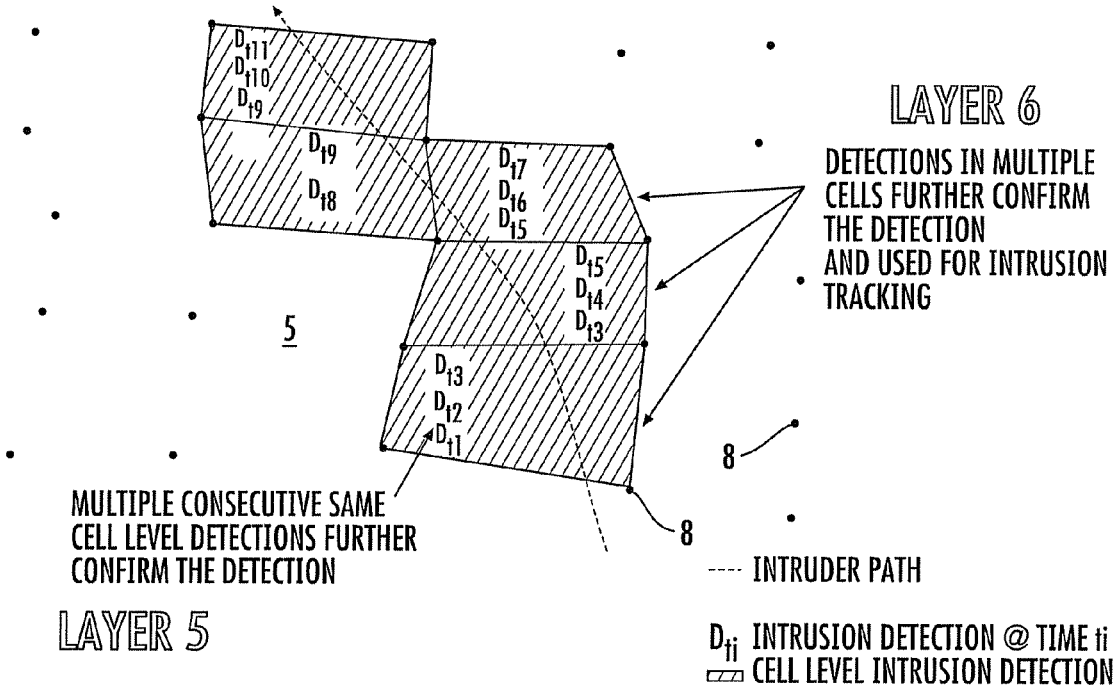
FIG. 7 is a schematic view of a Layers 5 and 6 intrusion confirmations of the intrusion detection and tracking system.

Referring to FIGS. 3A and 3B, for a stationary transmitter/receiver pair of nodes 8, any change in the position of obstacles in the volume of space covered by the transmitter 10 (FIG. 2) will affect the received signal strength and the link quality at the receiver end. A moving obstacle in the range of the transmitter will "disturb" the values of the signal strength indicator and the link quality indicator at the receiver 12, and these variations can be analyzed to both detect and track intrusions in the covered area 5.

FIGS. 3A and 3B show examples wherein an obstacle passes between two nodes 8 spaced apart about 25 feet in an outdoor setting with the transmitter/receiver pair using the IEEE 802.15.4 protocol. The RSSI value is as reported by the receiver 12. Referring to FIG. 3A, the right side of the graph shows the effect on the RSSI value caused by a human target H arbitrarily moving between the pair of nodes 8. Referring to FIG. 3B, the RSSI variations in the left portion of the graph are caused by a human target H walking along an approximate center line between the nodes 8. The right portion of the graph in FIG. 3B shows RSSI variations caused by a vehicle V driven back and forth along the same path.

Preferably, the nodes 8 are SoCs deployed in a grid along the perimeter or border of the area 5 to be monitored, as depicted in FIG. 1, to create the wireless network 6 that is ad-hoc. While the Figures show the nodes 8 forming an orderly grid, it will be apparent to one of ordinary skill in the art from this disclosure that the nodes 8 need not be located in an orderly manner to form the ad-hoc wireless network 6. In the system 1 of the present invention, the nodes 8 are scattered on the surface throughout the area 5 to be monitored in a way that would setup an electromagnetic field that would cover the area 5, i.e., provide surveillance. The spacing of the nodes 8 is dependent on the overall size of the area 5 for surveillance, the desired detection accuracy, and the corresponding power consumption by each node to attain the desired accuracy. One or more gateways 4 are used to form a data link between the network 6 and the DP 2, where processing software filters, correlates, and analyzes collected signal strength indicator values and link quality indicator values from the network 6 for the purpose of detecting and tracking disturbances to the electromagnetic field to determine the presence of intrusions.

Under control of a Network Control module 26 shown in FIG. 1 running on the DP 2, the nodes 8 will be periodically triggered to transition into a short self-configuration mode. In this mode, all nodes 8 will auto-adjust their transmission power through a succession of synchronized interrogate, listen, and adjust sequences. Each node 8 will adjust its transmission power so that its transmission is received only by first and second tier neighboring nodes 8, the first tier neighboring nodes 8 consist of the closest neighboring nodes 8 while the second tier neighboring nodes 8 consist of the next closest neighboring nodes 8. Note that, apart from maximizing the lifecycle of the system 1, this minimum required power use technique will also positively impact the false detection probability of the system. During the self-configuration phase, the nodes 8 become aware of neighboring nodes 8 and this information is relayed across the network 6 to ultimately reach the DP 2. The collected information is then processed and the relative position of every node 8 in the network is determined. This information is then used to inform the nodes 8 of optimal routes to convey intrusion detection data back to the DP 2. This technique will ensure minimal energy consumption by the network 6 thus contributing to increasing the system's 1 lifecycle.

To minimize false detection probability and to allow intrusion tracking across time through the area 5 for surveillance, the following multi-layered detection techniques are used. It should be noted that Layer-0 detection is preferably performed at the node level while Layer-1 to Layer-6 detection is preferably performed at the DP level. The detection techniques described in the following paragraphs are provided for purposes of illustration only and not by way of limitation, and it is to be understood that other processing systems may also be used without departing from the scope of the instant invention.

Layer-0 Detection

Layer-0 detection provides a first level improvement on the false detection probability. Layer 0 detection is an RSSI/LQI variation dual-threshold filtering performed by the software executed by the microcontroller unit 16 of the node 8 to establish the presence of an intrusion in its vicinity. The threshold triggering filters out variations to the field caused by presence of small volume intrusions objects such as leafs and branches. It also causes the nodes 8 to switch to a high transmission rate to produce a larger amount of detection data to be correlated by the DP 2 and allow a better resolution into the nature of the intrusion.

For the purpose of conserving energy, achieved by minimizing the overall transmission time, the nodes 8 will be transmitting at a low rate during no-intrusion periods. This preset transmission rate will be such that nodes 8 will be able to detect an intrusion traveling through the surveillance area 5 at a predetermined high speed. Upon determining the layer-0 detection, which is achieved at the node level, the node 8 will switch to a higher transmission rate and will command neighboring nodes 8, through transmitted data, to similarly switch to a higher transmission rate. The low transmission rate will be reestablished once the nodes 8 determine a no-intrusion period.

Layer-1 to Layer-4 Multi-Node Detection Correlation

As the node 8 assumes the transmitter role, the neighboring listening nodes 8 detect the disturbances to the wireless field caused by the intrusion in the vicinity of the nodes 8 and individually compute the variations in RSSI/LQI values (Layer-0) and this data, tagged with a serial number of the detecting node 8, is routed to the DP 2. The initial received data that is correlated as being from a group of nodes 8 listening to one particular node 8, defined as a cell, constitutes Layer-1 detection and indicates a good likelihood of positive intrusion detection. As a result, a Probable System Intrusion warning is initiated with a low value for a Detection Confidence Level (DCL) for the detection in the cell. As more detections are received at the DP 2 and are similarly correlated, the value of the DCL of the detection in the cell containing the nodes 8 is sequentially increased to indicate an increase in the confidence of the Positive System Intrusion warning.

As other nodes 8, surrounding the cell, assume in succession the transmitter role, other neighboring listening nodes 8 detect the disturbances to the wireless field caused by the same intrusion. This constitutes Layer-2 to Layer-4 Detection Correlation with Layer-4 reached when a preset number of the aforementioned correlations are reached. The value of the DCL increases as the Layer-2 to Layer-4 Detection Correlations are determined, again indicating a further increase in the confidence of a Positive System Intrusion.

Layer-5 Multi-Node Detection Correlation

As successive Layer-1 to Layer-4 Detection Correlations are asserted, Layer-5 processing correlates the detection across time within a single cell. The detection DCL is increased as additional Layer-5 correlation is performed.

Layer-6 Multi-Node Tracking Correlation

Layer-6 is used to track the intrusion as it travels across adjacent cells. An intrusion that traverses adjacent cells indicates a mobile intrusion and causes the Positive System Intrusion to be further affirmed and thus maintained. This is reflected by an increase in the value of the DCL. Conversely, a stationary intrusion remaining within one cell points to a possible false detection causing the value of the DCL to be decreased, indicating a decrease in the confidence of a Positive System Intrusion. If no further movement is detected from an intrusion, the intrusion may eventually be demoted to an anomaly.

Figure 8:
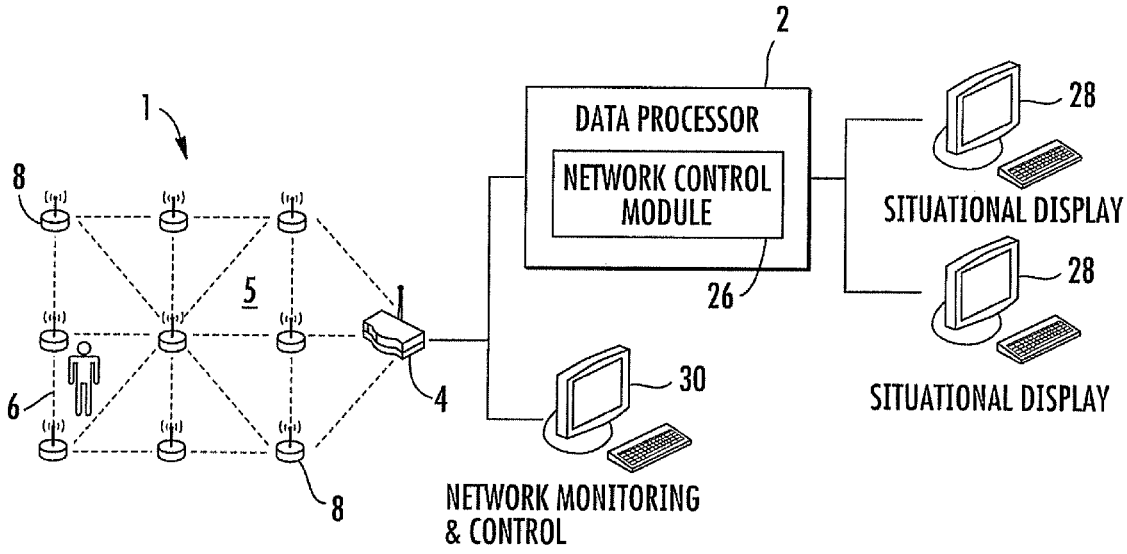
FIG. 8 is a view of an intrusion detection and tracking system according to another embodiment of the present invention.

FIG. 8 illustrates another embodiment of architecture for the system 1. The following provides a description of an exemplary operation of the system 1 of FIG. 1 or 8. In an initial self-configuration phase, each node 8 becomes aware of its within-reach neighboring nodes 8 through synchronized interrogate/listen sequences and accordingly adjusts its transmission power in a way that would allow it to be heard by a subset of the node neighbors 8. This allows the nodes 8 to minimize energy use during normal intrusion detection operation. This determined subset constitutes the list of first and second tier neighboring nodes 8 for which the node 8 monitors the signal strength indicator and/or the link quality indicator values, e.g., the RSSI/LQI values, as it listens to their transmissions. For this purpose, the node 8 constructs an internal table of the first and second tier neighboring node IDs, e.g., serial numbers of the nodes 8, paired with undisturbed indicator values, e.g., RSSI/LQI values.

At the end of the self-configuration phase, each node 8 transmits the contents of its internal table to be relayed by the downstream nodes 8 to the DP 2, where information from all nodes 8 is used to construct, using triangulation and node IDs correlation, a relative position geographical map of the nodes 8 in the network 6 based on known position of a few reference nodes 8. For a more accurate geographical map, GPS positioning of the reference nodes 8 may be performed during the network 6 installation. At the end of the tier table collection, the DP 2 signals the nodes 8 in the network 6 to switch to intrusion detection operation.

During intrusion detection operation, the majority of the nodes 8 operate in a synchronized low energy consumption "sleep-and-listen" mode. Periodically and in sequence at the low energy saving rate, the nodes 8 switch one at a time to a transmit mode to allow the listening nodes 8 to perform Layer-0 intrusion detection filtering.

As an intruding object enters the surveillance area 5 causing a disturbance in the electromagnetic field, at least one of the listening nodes 8 in the vicinity of the intrusion will detect this disturbance and alerts the neighboring nodes 8 to switch to a high rate transmit mode. This allows other nodes 8 in the vicinity of the intruding object to collect Layer-0 intrusion information at a higher rate and as each node 8 switches to the transmit mode, the available Layer-0 intrusion information is transmitted to be relayed by the network 6 to the DP 2. As the intruding object moves away from the vicinity of the nodes 8 which are transmitting at the high transmit rate and the disturbance in the electromagnetic field sensed by the nodes 8 ceases, the nodes 8 revert back to the low energy saving transmit rate.

The DP 2 processes the intrusion data as it receives it and correlates it based on the node 8 IDs tagged to the data and, using the geographical map constructed in the initial configuration phase, initiates a Positive System Intrusion warning with a low value of DCL with a known position in the area 5. This constitutes Layer-1 intrusion detection processing. As more intrusion data from other nodes 8 is received and correlated to the initiated Positive System Intrusion warning, thereby causing DCL values to increase above a "Probable" DCL level, a geo-located intrusion warning at one or more situational displays 28 is initiated. This constitutes Layer-2 to Layer-4 detection processing.

As the intrusion moves within a cell of the surveillance area 5 triggering Layer-0 of new nodes 8 and as this intrusion data reaches the DP 2, it is correlated to an existing Probable System Intrusion warning causing its DCL value to be incremented and, when this reaches a Confirmed DCL level, the warning at the situational display(s) 28 is promoted to a geo-located intrusion alarm. This constitutes Layer-5 detection tracking across time.

With the intruding object moving across cells of the wireless network 6 sequentially triggering a trail of nodes 8, Layer-0 intrusion information reaching the DP 2 is correlated to the previously confirmed Positive System Intrusion, thereby allowing the geo-located intrusion to be tracked and updated on the situational display(s) 28. This constitutes Layer-6 detection tracking across cells.

The situational display(s) 28 are preferably configured to provide a geographical display of the area 5, intrusion warning/alerts as well as an intrusion display.

Finally, in order to maintain an optimally tuned network 6, the network control module 26, having network control software running in the DP 2, periodically issues reconfiguration control commands to the nodes 8 in the network 6 to re-enter the self-configuration mode allowing the nodes 8 to resynchronize.

The DP 2 and its modules and/or components can be made of up software and/or hardware as will be apparent to one of ordinary skill in the art. Furthermore, the DP 2, with its software and/or hardware, preferably processes the multi-layered intrusion detection (layers 1-4), the layer 5 intrusion correlation, the layer 6 intrusion tracking, behavior pattern recognition, external systems interface, e.g. video cueing, and network control. Network control can be monitored or modified by a user at a network monitoring and control station 30. The user can monitor network health, control or activate individual nodes 8, and/or remotely program the node 8 at the network monitoring and control station 30. At the node 8 level, the signal strength processing, the layer 0 intrusion detection and the power consumption management are managed using software and/or hardware as will be apparent to one of ordinary skill in the art from this disclosure.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. The terms of degree such as "substantially", "about" and "approximate" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Thus, the foregoing descriptions of the embodiments according to the present invention are provided for illustration only, and not for the purpose of limiting the invention as defined by the appended claims and their equivalents.

What is claimed is:

1. An intrusion detection and tracking system comprising:

a plurality of nodes disposed about an area to be monitored, said plurality of nodes forming a wireless network and configured to transmit data and receive data frames with a signal strength indicator and a link quality indicator in the frames;

a data processor (DP) communicatively connected to the network and configured to analyze variations in the signal strength indicator and link quality indicator to detect and track disturbances to an electromagnetic field in the area a display, coupled to the DP, the display for displaying a condition of intrusion in response to the DP detecting and tracking disturbances to an electromagnetic field; and a gateway configured to form a data link between the network and the DP.

2. The intrusion detection and tracking system of claim 1, wherein an intrusion is detected by monitoring variations in both the signal strength indicator and the link quality indicator.

3. The intrusion detection and tracking system of claim 1, wherein the signal strength indicator is a received signal strength indicator (RSSI) and the link quality indicator is a link quality index (LQI).

4. The intrusion detection and tracking system of claim 1, wherein the nodes are configured with an adaptable transmission rate.

5. The intrusion detection and tracking system of claim 1, wherein the DP triggers the nodes into a self-configuring mode in which all nodes auto-adjust their transmission power.

6. The intrusion detection and tracking system of claim 5, wherein the transmission power is adjusted so that the transmission is received by first and second tier neighboring nodes.

7. The intrusion detection and tracking system of claim 1, wherein the DP is configured to calculate successive levels of detection confidence to provide false detection probabilities.

8. The intrusion detection and tracking system of claim 7, wherein the levels of detection confidence are directly related to a plurality of layers of detection.

9. The intrusion detection and tracking system of claim 8, wherein a first layer of detection is performed at the nodes.

10. The intrusion detection and tracking system of claim 9, wherein the first layer of detection at the nodes triggers one or more of the nodes to transmit at a higher transmission rate.

11. The intrusion detection and tracking system of claim 9, wherein each layer of detection after the first layer of detection are performed at the DP.

12. A system for detecting and tracking an object in an area, the system comprising:

a plurality of nodes disposed about the area and establishing a wireless network and an electromagnetic field in the area, each of said plurality of the nodes configured to transmit data and receive a data with at least one other node and wherein at least some of the data includes a signal strength indicator and a link quality indicator and wherein each node monitors changes in at least one of the signal strength indicator and the link quality indicator from one transmission to another and uses such changes to detect the object;

a data processor communicatively coupled to the wireless network and configured to receive and analyze information provided thereto from at least some of said plurality of nodes; and a display, coupled to the data processor and configured to display a condition of intrusion in response to analyzed information from the data processor.

13. The system of claim 12 wherein each node monitors changes in at least one of the signal strength indicator and the link quality indicator from at least one of a predetermined level and from one transmission to another and uses such changes to detect the object.

14. The system of claim 12 wherein each node is configured to transmit data and receive data frames with at least one other node and wherein at least some of the data frames include a signal strength indicator and a link quality indicator and wherein each node monitors at least one of changes in at least one of the signal strength indicator and the link quality indicator from one transmission to the other and changes from a predetermined level and uses such changes to detect the object.

15. The system of claim 12 wherein each of said plurality of nodes performs processing to establish the presence of a potential intrusion in the vicinity of the node.

16. The system of claim 15 wherein each of said plurality of nodes is provided as a system on a chip (SoC) and wherein each SoC includes a central processing unit (CPU) in which processing is performed to establish the presence of a potential intrusion in the vicinity of the node.

17. The system of claim 15 wherein the processing performed by each of said nodes to establish the presence of a potential intrusion in the vicinity of the node comprises dual-threshold filtering.

18. The system of claim 15 wherein in response to a node establishing the presence of a potential intrusion, said node switches from a first transmission rate to a second transmission rate wherein an amount of detection data produced at the second transmission rate is greater than an amount of detection data produced at the first transmission rate.

19. The system of claim 15 wherein each of said plurality of nodes transmits data at a first transmission rate during no-intrusion periods and wherein the first transmission rate is selected such that the nodes can detect a potential intrusion traveling through the area at a predetermined speed.

20. The system of claim 19 wherein in response to a node establishing the presence of a potential intrusion, the node switches to a second transmission rate and commands neighboring nodes transmitting at a first transmission rate to switch to a second transmission rate.

21. The system of claim 20 wherein in response to a node determining that there is no longer a potential intrusion, the node begin transmitting at the first transmission rate.

22. The system of claim 12 wherein in response to the link quality indicator corresponds to a link quality index (LQI) and the signal strength indicator corresponds to a received signal indicator (RSSI) and wherein each of said plurality of nodes uses one or more of RSSI changes from one transmission to another and changes from a predetermined level.

23. The system of claim 22 wherein each of said plurality of nodes determines if the changes in the RSSI are significant enough to represent a potential intrusion.

24. The system of claim 12 wherein each of said plurality of nodes is provided as a system on a chip (SoC) and wherein each SoC includes a central processing unit (CPU) in which processing is performed to establish the presence of a potential intrusion in the vicinity of the node and wherein each SoC comprises:

a transmitter; and a receiver and wherein each transmission by a node is received by as many as nine other nodes.

25. The system of claim 12 wherein said data processor is configured to compute successive levels of detection confidence and wherein the levels of detection confidence are directly related to a plurality of layers of detection.

26. The system of claim 25, wherein a first layer of detection is performed at the nodes.

27. The system of claim 26, wherein the first layer of detection at the nodes triggers one or more of the nodes to transmit at a higher transmission rate.

28. The system of claim 27, wherein each layer of detection after the first layer of detection are performed at the data processor.

* * * * *